US008511783B2

(12) United States Patent
Izumikawa

(10) Patent No.: US 8,511,783 B2
(45) Date of Patent: Aug. 20, 2013

(54) IMAGE FORMING APPARATUS AND IMAGE FORMING METHOD

(75) Inventor: Manabu Izumikawa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 134 days.

(21) Appl. No.: 13/167,119

(22) Filed: Jun. 23, 2011

(65) Prior Publication Data

US 2011/0316923 A1 Dec. 29, 2011

(30) Foreign Application Priority Data

Jun. 29, 2010 (JP) ..... 2010-148122
Jun. 8, 2011 (JP) ..... 2011-128266

(51) Int. Cl.
*B41J 29/38* (2006.01)

(52) U.S. Cl.
USPC ..... 347/16

(58) Field of Classification Search
CPC ..... B41J 3/42
USPC ..... 347/5, 16, 101, 104
See application file for complete search history.

(56) References Cited

U.S. PATENT DOCUMENTS 6,758,545 B2 * 7/2004 Ikeda et al. ..... 347/16
7,896,489 B2 * 3/2011 Tanabe ..... 347/104
2010/0091056 A1 4/2010 Miyagi et al.

FOREIGN PATENT DOCUMENTS

JP 2005-205766 8/2005
JP 2005-225207 8/2005
JP 2006-076155 3/2006
JP 2010-094814 4/2010

* cited by examiner

*Primary Examiner* — An Do
(74) *Attorney, Agent, or Firm* — IPUSA, PLLC

(57) ABSTRACT

A disclosed image forming apparatus includes an image forming unit configured to discharge ink for forming an image on a recording medium or for idle-discharging the ink; a carrying unit configured to carry the recording medium and include an idle discharge region for receiving the ink which is idle-discharged; a determining part configured to determine whether the recording medium is positioned at the idle discharge region; and a changing part configured to change, if the determining part determines that the recording medium is positioned at the idle discharge region, a direction of the recording medium so that the recording medium is not positioned at the idle discharge region.

20 Claims, 12 Drawing Sheets

【CAUTION !】
NO PAPER IN SECOND TRAY.
CHARGE PAPER TO SECOND TRAY OR
MAKE PAPER TYPE AND PAPER THICKNESS
BE THE SAME AS THOSE OF PAPER IN FIRST TRAY.

【CAUTION !】BECAUSE STABLE PAPER DIRECTION MODE IS EMPLOYED, PRINTING PRODUCTIVITY IS LOWERED IN COMPARISON WITH VARIABLE PAPER DIRECTION MODE.

| DISTANCE BETWEEN RECORDING MEDIUM AND IDLE-DISCHARGE REGION | QUANTITY OF INK TO BE IDLE-DISCHARGED |
|---|---|
| $Y_1$ | $Z_1$ |
| ⋮ | ⋮ |
| Yn | Zn |

IMAGE FORMING APPARATUS AND IMAGE FORMING METHOD

BACKGROUND OF THE INVENTION

1. Field of the Invention

The present invention relates to an image forming apparatus for forming an image on a recording medium.

2. Description of the Related Art

Ink in the nozzle face of a recording head installed in an image forming apparatus may be easily dried when the ink is not discharged for a long time because concentration of the ink and the degree of ink viscosity become high. Then, it is possible to solve the problem by idle-discharging ink which is not used for forming an image.

In Patent Document 1, through holes for idle discharge are provided on a carrying belt. With this technique, the carrying belt is electrically charged to fix a paper to the carrying belt. Ink is idle-discharged to pass through the through holes.

Patent Document 1: Japanese Laid-Open Patent Application No. 2010-094814

SUMMARY OF THE INVENTION

Accordingly, embodiments of the present invention may provide a novel and useful image forming apparatus which can appropriately idle-discharge ink without degrading image forming productivity in forming images.

One aspect of the embodiments of the present invention may be to provide an image forming apparatus including an image forming unit configured to discharge ink for forming an image on a recording medium or for idle-discharging the ink; a carrying unit configured to carry the recording medium and include an idle discharge region for receiving the ink which is idle-discharged; a determining part configured to determine whether the recording medium is positioned at the idle discharge region; and a changing part configured to change, if the determining part determines that the recording medium is positioned at the idle discharge region, a direction of the recording medium so that the recording medium is not positioned at the idle discharge region.

Additional objects and advantages of the embodiments will be set forth in part in the description which follows, and in part will be clear from the description, or may be learned by practice of the invention. Objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

DETAILED DESCRIPTION OF THE PREFERRED EMBODIMENTS

A description is given below, with reference to the FIG. 1 through FIG. 16 of embodiments of the present invention. Reference symbols typically designate as follows:

1: first stack;
2: paired resist rollers;
4: image forming unit;
5: paper feeding roller;
6: belt roller;
7: belt roller;
8: paper carrying belt;
8X: upper path along paper carrying belt;
8Y: lower path along paper carrying belt;
9: first paper detecting unit;
10: recording position detecting unit;
11 second paper detecting unit;
14: paper end detecting part;
15: catch tray;
16: belt reference hole array detecting sensor;
17: belt reference hole array detecting marker;
18: recording head;
18Y: recording head (yellow);
18M: recording head (magenta);
18C: recording head (cyan);
18K: recording head (black);
19: back end of immediately preceding paper;
20: front end of immediately subsequent paper;
21: nozzle;
22: idle discharge ink tray;
30: idle discharge region; and
31: ejecting destination switching claw.

(Explanation of Terminologies)

Terminologies used in the Embodiments typically mean as follows.

An image forming apparatus includes a printer, a facsimile machine, a copier, a plotter, and a multifunction peripheral.

The recording medium may be a paper, a textile thread, yarn, textiles, threadline, leather, a metal, a plastic, glass, lumber, timber, wood or a ceramic. In the following description, a paper is used as the recording medium.

Image forming is an action of giving an image such as a letter, a graphic form and a pattern to a recording medium or making a recording medium receive droplets.

Hereinafter, the droplets may be made of ink, recording liquids, fixing liquids, liquids for forming an image, deoxyribonucleic acid (DNA) samples, resists, pattern materials, and resins. Hereinafter, the droplets made of ink are used in the Embodiments.

Next, an idle discharge is explained. If the ink is easily dried such as an aqueous ink, an ink concentration and degree of ink viscosity at and around a nozzle face of a recording head and an ink accommodating container of the recording head become high after a long break in discharging the ink from the nozzle. Then, the ink cannot be properly discharged (hereinafter, referred to as a mal-discharge). Then, ink which does not form the image or contribute to the image formation may be discharged at a predetermined timing to prevent the mal-discharge. This discharging the ink at the predetermined timing may be called idle discharge.

Figure 1A:
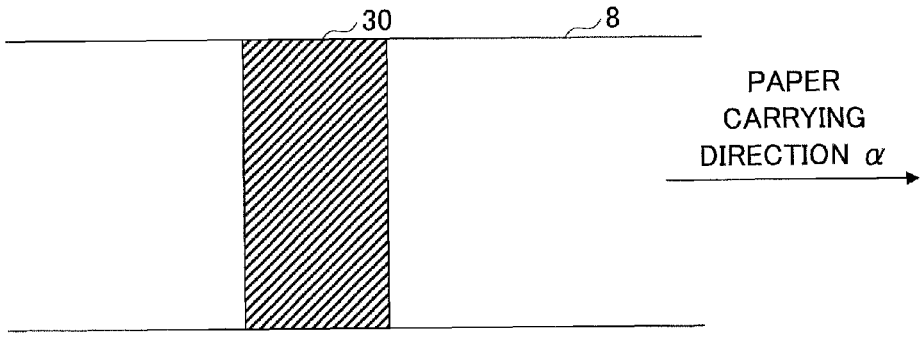
FIG. 1A, FIG. 1B and FIG. 1C illustrate a positional relationship between a carrying belt and papers.
Figure 1B:
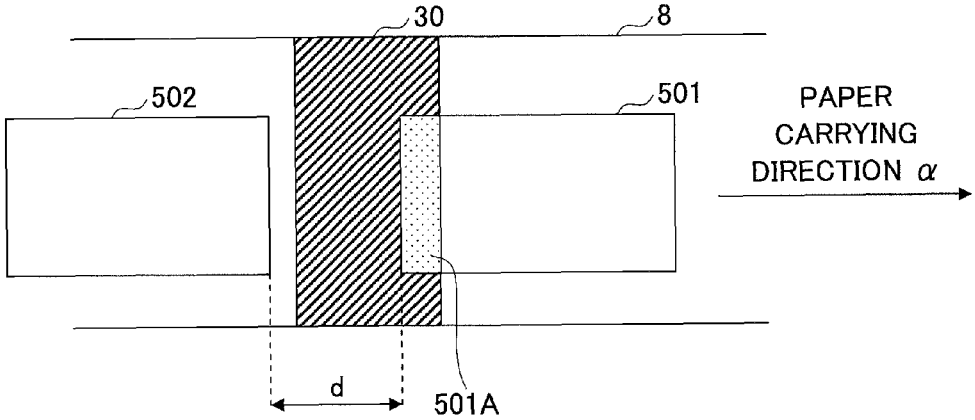
Figure 1C:
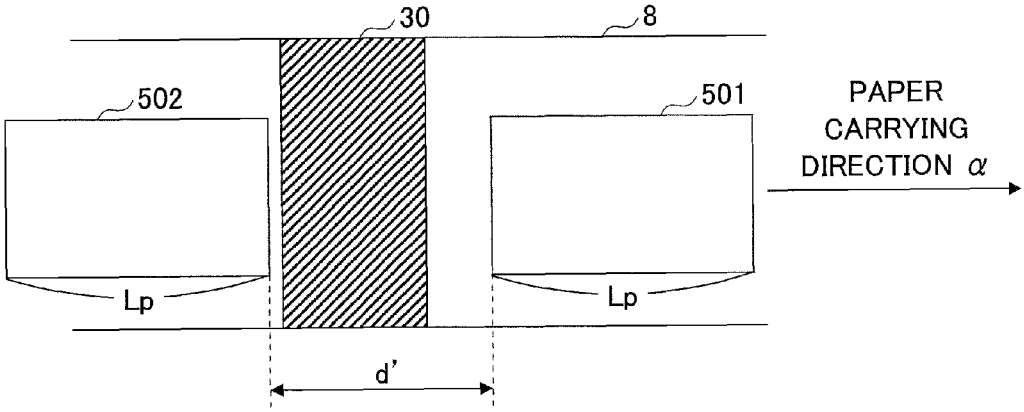

FIG. 1A to FIG. 1C illustrate a paper 501 carried on a carrying belt 8 in an image forming apparatus. Referring to FIG. 1A, an idle discharge region 30 having plural through holes is provided in the carrying belt 8. The idle discharge region 30 is shaded in FIG. 1A. When the idle discharge region 30 is positioned immediately below a recording head, the recording head carries out idle-discharging over the idle discharge region 30.

Referring to FIG. 1B, if a part 501A or all of the paper 501 is positioned over the idle discharge region 30, the idle discharge with the recording head cannot be carried out. This is because the ink idle-discharged is discharged on the part 501A or all of the paper 501. Referring to FIG. 1B and FIG. 1C, a paper positioned immediately before (downstream) the idle discharge region 30 is referred to as an immediately preceding paper 501 and a paper positioned immediately after (upstream) the idle discharge region 30 is referred to as an immediately subsequent paper 502. Further, in FIG. 1B, an interval between the immediately preceding paper 501 and the immediately subsequent paper 502 is referred to as a paper interval d.

Referring to FIG. 1C, the papers may not be positioned over the idle discharge region 30. If the papers are not positioned over all the idle discharge region, a paper interval d' between the immediately preceding paper 501 and the immediately subsequent paper 502 becomes greater than the paper interval d. Therefore, productivity becomes lowered in the paper arrangement of FIG. 1C in comparison with the paper arrangement of FIG. 1B. A break in discharging the ink in FIG. 1C is longer than a break in discharging the ink in FIG. 1B. Therefore, a nozzle face will be further dried.

Embodiment 1

(Hardware Configuration)

Figure 2:
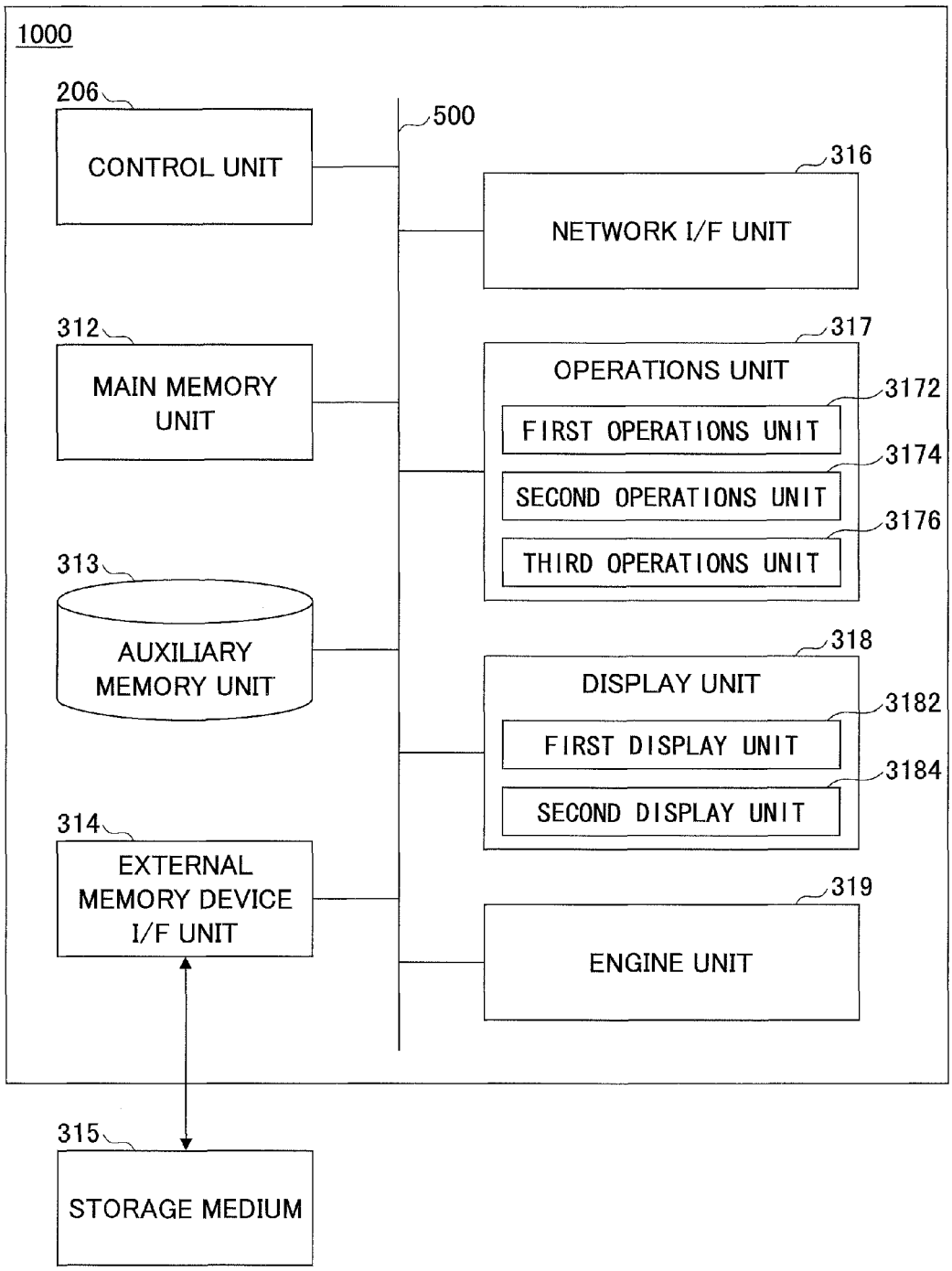
FIG. 2 illustrates an example hardware configuration of an image forming apparatus of Embodiment 1.

Referring to FIG. 2, an example hardware configuration of an image forming apparatus 1000 of an Embodiment is illustrated. Referring to FIG. 2, the image forming apparatus 1000 includes a control unit 206, a main memory unit 312, an auxiliary memory unit 313, an external memory device I/F unit 314, a network I/F unit 316, an operations unit 317, a display unit 318, and an engine unit 319, which are connected by a bus 500.

The control unit 206 may include a CPU installed in a computer to carry out controls of various units and devices as well as operations and processing of data. The CPU is an arithmetic device which runs programs stored in the main memory unit 312, receives data from an input device or a memory device, provides arithmetic computation and processing, and outputs to an output device or the memory device.

The main memory unit 312 may be a Read Only Memory (ROM) or a Random Access Memory (RAM), and constantly or temporarily store programs and data such as an Operating System (OS) being basic software or application software, processed by the control unit 206.

The auxiliary memory unit 313 may be a Hard Disk Drive (HDD) and stores data related to the application software or the like. The external memory device I/F unit 314 is an interface between a storage medium 315 such as a flash memory and the image forming apparatus 1000 connected via a data communication line such as a universal serial bus (USB).

The storage medium 315 stores a predetermined program, and the program stored in the recording medium 315 is installed in the image forming apparatus 1000 via the external memory device I/F unit 314. The installed program can be run by the image forming apparatus 1000.

The network I/F unit 316 is an interface between the image forming apparatus 1000 and peripheral apparatuses which have a communication function and is connected to the peripheral apparatuses via a network such as a Local Area Network (LAN) and a Wide Area Network (WAN) formed with wired or wireless data transmission paths.

The operations unit 317 and the display unit 318 may be constructed of a Liquid Crystal Display (LCD) having key switches (hardware keys) and a touch panel including software keys of a Graphical User Interface (GUI). The operations unit 317 and the display unit 318 are User Interfaces (UI) for utilizing the functions of the image forming apparatus 1000. The operations unit 317 includes a first operations unit 3172, a second operations unit 3174 and a third operations unit 3176. The display unit 318 includes a first display unit 3182 and a second display unit 3184. The first operations unit 3172, the second operations unit 3174, and the third operations unit 3176 may be integrated into the operations unit 317. The first display unit 3182 and the second display unit 3182 may be integrated into the display unit 318.

The engine unit 319 drives mechanical portions for forming images with a scanner and a plotter or the like and various motors or the like.

(Functional Structure of Important Portions)

Figure 3:
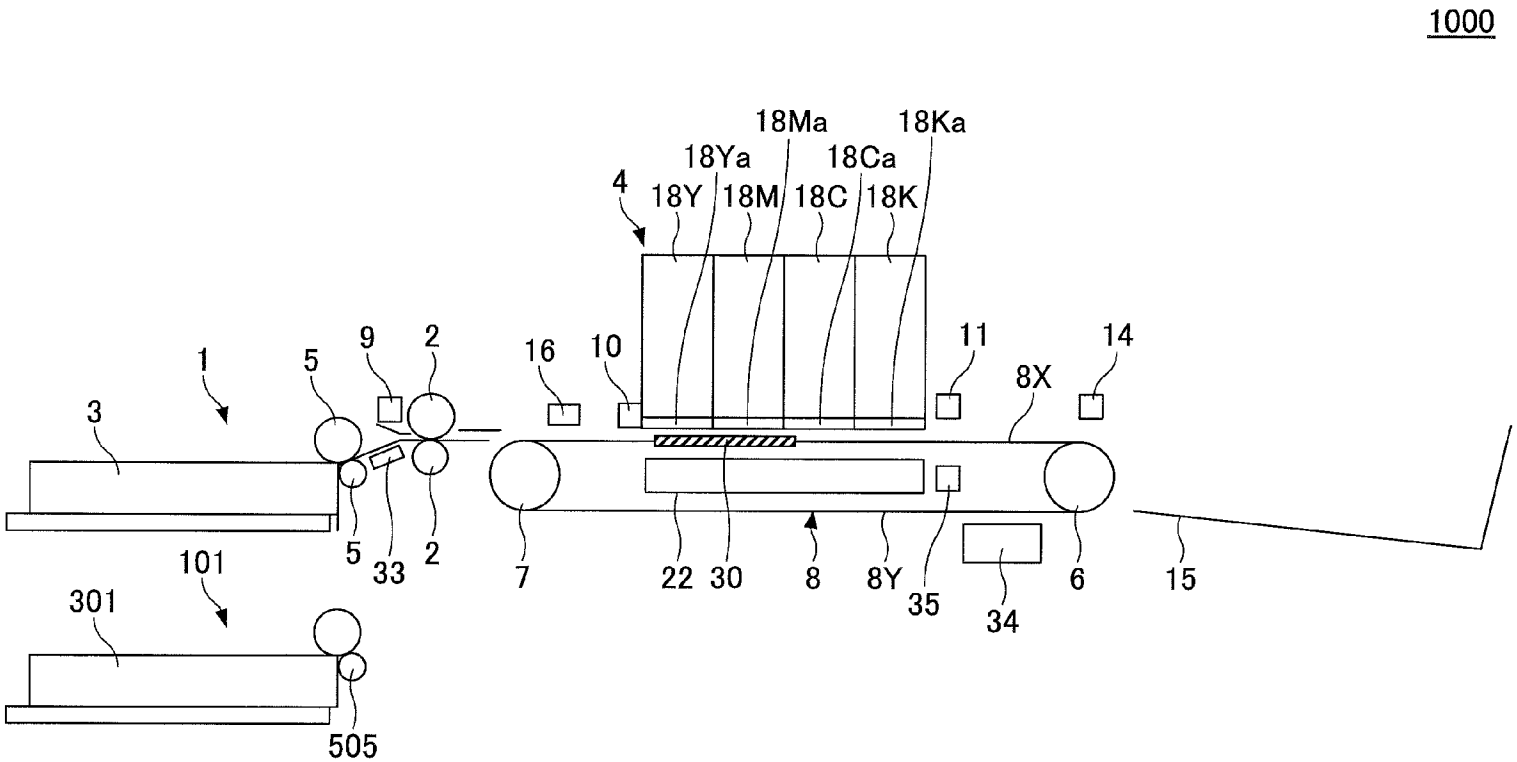
FIG. 3 illustrates an example hardware configuration of the image forming apparatus of Embodiment 1.

FIG. 3 schematically illustrates an example hardware configuration of the image forming apparatus 1000 of Embodiment 1. Referring to FIG. 3, an image forming apparatus 1000 which can print color images is illustrated. On an upstream side of the image forming apparatus 1000, a first stack 1 is provided. On the downstream side of the image forming apparatus 1000, a catch tray 15 is provided. Hereinafter, a route for the paper from the first stack 1 to the catch tray is referred to as a path.

Plural first papers 3 are accommodated in the first stack 1. Plural second papers 301 are accommodated in the second stack 101. The second stack 101 is described later. Hereinafter, a paper which is not indicated by a reference symbol is described. The paper which is not indicated by the reference symbol is physically the same as the first paper 3, the second paper 301, the immediately preceding paper 501 and the immediately subsequent paper 501. Specifically, the paper which is not indicated by the reference symbol is supplied from the first stack and the second stack. The paper which is not indicated by the reference symbol may not be positioned immediately before or after the idle discharge region 30 unlike the immediately preceding paper 501 and the immediately subsequent paper 502.

On an immediately downstream side of the first stack 1, a pair of paper feeding rollers 5 and a pair of resist rollers 2 are provided. A sheet of the first paper 3 is separated from plural sheets of the first paper 3, and carried to the carrying belt 8 while being gripped between the pair of paper feeding rollers 5 and between the pair of resist rollers 2.

On an immediately downstream side of the second stack 101, a pair of paper feeding rollers 505 and a pair of resist rollers (not illustrated) are provided. A sheet of second paper 301 is separated from plural sheets of the second paper 301, and carried to the carrying belt 8 while being gripped between the pair of paper feeding rollers 505 and between the pair of resist rollers.

The carrying unit is provided to carry the papers and may include a carrying belt 8. Hereinafter, an example in which a carrying belt 8 is included in the carrying unit is described. The carrying belt 8 is endless and shaped like a loop. The carrying belt 8 is bridged between a belt roller 6 and a belt roller 7. The carrying belt 8 includes an upper path 8X for forwarding the paper and a lower path 8Y moving opposite to the upper path 8X. The carrying belt 8 has an insulating layer on its surface. A charging device (not illustrated) may give an electric charge to the surface of the carrying belt 8, the surfaces of the papers, or the surface of the carrying belt 8 and the surfaces of the papers. Therefore, the surface of the carrying belt 8 is electrostatically adhered to the back surface of the paper such as the first paper 3 and the paper is fixed to the carrying belt 8.

The image forming unit 4 faces a surface of the upper path 8X of the carrying belt 8. The image forming unit 4 includes recording heads 18Y, 18M, 18C and 18K of yellow (Y), magenta (M), cyan (C) and black (K). The image forming unit 4 forms an image corresponding to image data on a paper. The image forming unit 4 idle-discharges ink which is not used to form the image. Hereinafter, these recording heads are collectively referred to as a recording head 18. The recording heads 18Y, 18M, 18C and 18K are arranged along a paper carrying direction $\alpha$ of the carrying belt. The recording heads 18Y, 18M, 18C and 18K have nozzle faces 18Ya,18Ma,18Ca and 18Ka, respectively. The nozzle faces 18Ya,18Ma,18Ca and 18Ka have corresponding nozzle apertures (not illustrated) for discharging ink toward the surface of the carrying belt 8. The number of the nozzle apertures is many and arranged in a direction orthogonal to the paper carrying direction $\alpha$ of the carrying belt 8. Because a gap is provided between the nozzle surfaces 18Ya, 18Ma, 18Ca and 18Ka and the surface of the carrying belt 8, the first paper 3 can pass beneath the recording heads 18Y, 18M, 18C and 18K.

The first paper 3 fixed to the surface of the carrying belt 8 sequentially passes beneath the recording heads 18Y, 18M, 18C and 18K, and simultaneously the inks of the colors are subsequently discharged from the nozzle holes toward the upper surface of the first paper 3. Thus, a desired color image is formed. The first paper 3 on which the image is formed is accommodated in the catch tray 15.

Idle discharge holes (through holes) for getting the idle-discharged ink from the recording head 18 through the carrying belt 8 are provided in the idle discharge region in a predetermined area of the carrying belt 8. Further beneath the idle discharge holes of the carrying belt 8, an idle discharge ink tray 22 for accommodating the idle-discharged ink is provided.

A first paper detecting unit 9 reads the position and size of the first paper 3. A recording position detecting part 10 determines an ink injecting timing for the first paper 3 and also detects the back end of the first paper 3. A second paper detecting unit 11 reads the position of the first paper 3. A paper end detecting part 14 determines paper jamming and a timing for supplying a next paper.

(Printing)

Next, a printing process is described. Image data to be printed is input from a host computer (not illustrated) through the network I/F unit 316 (illustrated in FIG. 2). Then, the image data are stored in the main memory unit 312. The control unit 206 drives the engine unit 319 and drives the paired paper feeding rollers 5, separates the uppermost sheet from stacked sheets of the first paper 3 illustrated in FIG. 1, and carries the sheet toward the paired resist rollers 2. The control unit 206 drives the belt roller 6 at a predetermined timing via the engine unit 319 to thereby start a carrying operation (rotating operation) of the paper carrying belt 8.

The control unit 206 receives a detection signal by the first paper detecting unit 9. Then, after a predetermined timing, the control unit 206 causes the engine unit 319 to drive the paired resist rollers 2 to put the first paper 3 on the surface of the upper path 8X of the carrying belt 8. Hereinafter, putting a paper on the surface of the upper path 8X is referred to as "resisting restart".

The image data stored in the main memory unit 312 is sent to a print control part (not illustrated) and is converted to dot data for the colors via a head driver (not illustrated). The head driver takes the dot data in and generates a driving control signal for the recording head 18. By applying a drive control signal generated by the head driver to nozzles of the recording head 18, the ink is discharged from the nozzles to the first paper 3.

When the front end of the first paper 3 passes beneath the recording position detecting part 10, the recording position detecting part 10 sends information indicative of passing of the front end to the control unit 206. When the control unit 206 receives the information indicative of passing of the front end, the control unit 206 makes the recording head 18 print the image on the first paper 3 based on the received information.

(Idle Discharge Region)

Figure 4:
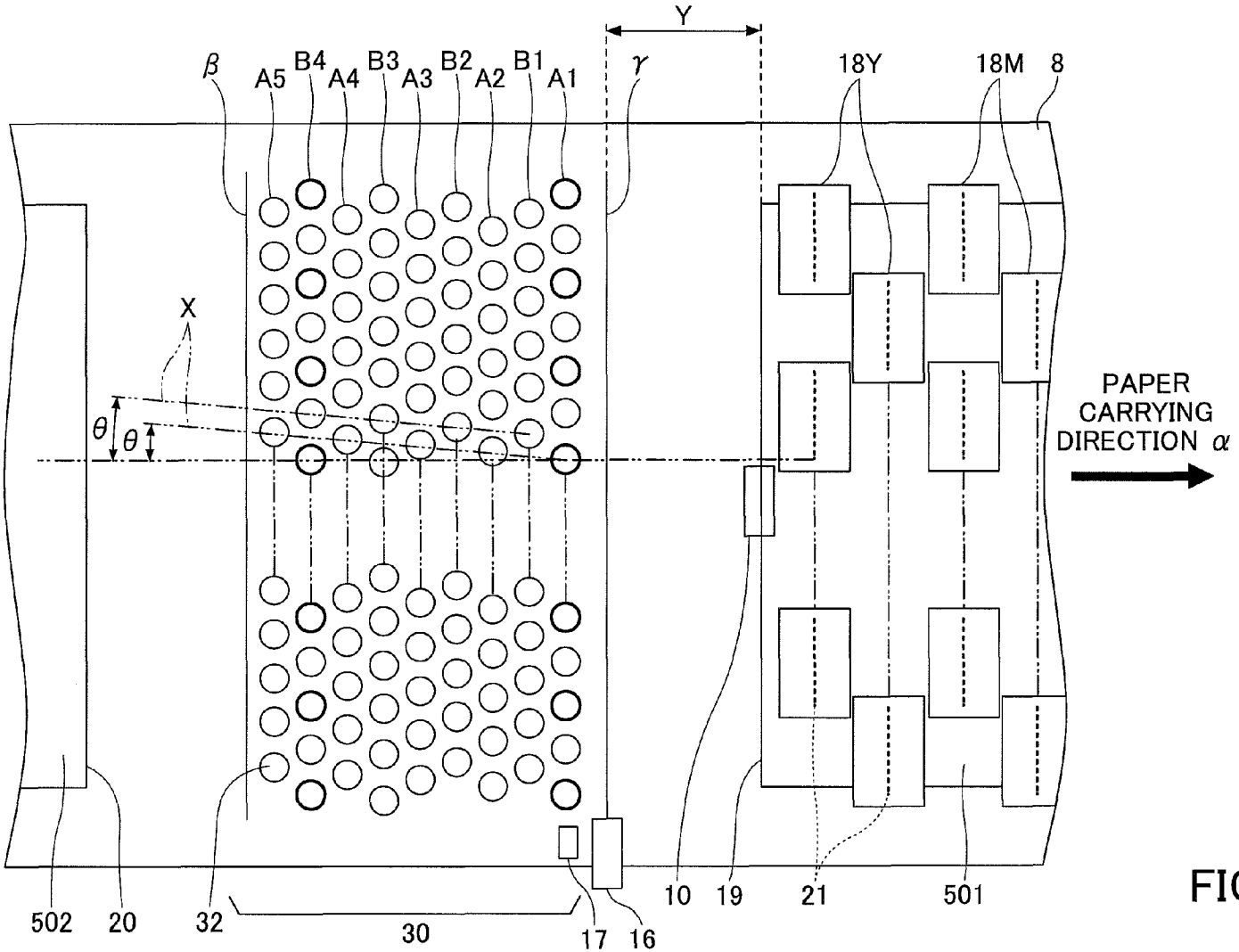
FIG. 4 illustrates an idle-discharging region of Embodiment 1.

Next, the idle discharge region is described. FIG. 4 illustrates the idle discharge region 30 of the carrying belt 8. Referring to FIG. 4, the total length of the recording heads 18 in a direction orthogonal to the paper carrying direction a corresponds to the paper width of the first paper 3. The recording heads 18 may be a so-called line-type head, arranged in a zigzag shape along the width direction of the carrying belt 8. Nozzles 21 are also arranged in the width direction of the carrying belt 8.

Next, the idle discharge region 30 is described. As described, the idle discharge region 30 is provided in the predetermined area of the carrying belt 8. Referring to FIG. 4, plural idle discharge holes 32 are formed in the idle discharge region 30. The plural idle discharge holes 32 are provided to pass through positions facing all the nozzles 21. Referring to FIG. 4, the idle discharge hole arrays A1 to A5 and B1 to B4 are arranged from the downstream side of the paper carrying direction $\alpha$ (from right to left in FIG. 4) with predetermined gaps interposed among the idle discharge holes 32. Referring to FIG. 4, the center lines of the idle discharge holes 32 in the arrays A1 to A5 and B1 to B4 are arranged on imaginary line sections which are inclined by a predetermined angle $\theta$ from the paper carrying direction $\alpha$ on the carrying belt 8. The idle discharge holes 32 are arranged in the direction orthogonal to the paper carrying direction $\alpha$ while interposing the predetermined gaps in the direction orthogonal to the paper carrying direction $\alpha$.

Further, referring to FIG. 4, the array A1 is referred to as a reference array. A belt reference hole array detecting marker 17 is provided in a side end portion of the carrying belt 8. A belt reference hole array detecting sensor 16 detects the belt reference hole array detecting marker 17 to thereby generate a detection signal. Then, the generated detection signal is sent to the control unit 206. When the control unit 206 receives the detection signal, it is detected that the reference array A1 on the idle discharge region 30 passes beneath the belt reference hole array detecting sensor 16.

Further, if the recording head 18 does not discharge the ink for forming the image for a predetermined time or if the recording head discharges the ink for the predetermined times for forming the image, the idle discharge process is carried out by the control of the control unit 206.

As illustrated in FIG. 4, when the idle discharge region 30 is positioned between a back end 19 of an immediately preceding paper 501 and a front end 20 of an immediately subsequent paper 502, the recording head 18 idle-discharges ink to the idle discharge region 30. The size of the immediately preceding paper 501 and the size of the immediately subsequent paper 502 may be the same. The timing of moving the recording head 18 does not change at the time of normal printing and at the time of idle-discharging.

(Printing Productivity)

Printing productivity is described next. The printing productivity means the number of forming (printing) images per a unit time. The higher the printing productivity becomes, the more the papers are printed. The printing productivity is determined in designing the image forming apparatus. The timing of resisting restart (putting a paper on the carrying belt 8) relates to the printing productivity of the image forming apparatus. As illustrated in FIG. 1B, a part or all of the paper needs not to be positioned on the idle discharge region 30 including the idle discharge holes 32 at the time of idle discharge. This is because when the idle discharge region 30 is covered by the paper, the idle-discharged ink adheres to the paper. The paper may not be sufficiently adhered to the idle discharge region 30 because the idle discharge holes 32 cannot have electric charges.

Therefore, it is necessary to put the papers on a region other than the idle discharge region 30 at the time of resisting restart. The control unit 206 can acquire the position of the idle discharge region 30 by receiving the detection signal from the belt reference hole array detecting sensor 16. With the control unit 206, the papers can be put on the region other than the idle discharge region 30 of the carrying belt 8.

Here, image forming productivity G is represented by the following formula 1. A reference symbol G designates the number of prints per unit time, e.g., one minute. A reference symbol v designates a speed of the carrying belt 8 in the paper carrying direction α illustrated in FIG. 4. Referring to FIG. 1C, a reference symbol Lp designates the length of the paper carrying direction α of the immediately preceding paper 501 put on the carrying belt 8. Referring to FIG. 1B, the paper interval d is a distance between the back end 19 of the immediately preceding paper 501 and the front end 20 of the immediately subsequent paper 502, the immediately preceding paper 501 and the immediately subsequent paper 502 being adjacent to each other and put on the carrying belt 8. Here, referring to FIG. 1A, FIG. 1B, FIG. 1C and FIG. 5, the idle discharge region 30 is interposed between the immediately preceding paper 501 and the immediately subsequent paper 502. The immediately preceding paper 501 is positioned on the downstream side of the paper carrying direction α relative to the idle discharge region 30, and the immediately subsequent paper 502 is positioned on the upstream side of the paper carrying direction α relative to the idle discharge region 30 (see FIG. 1B and FIG. 1C).

From the relationship of 60/G=(Lp+d)/v, Formula 1 is obtainable.

$$G=60v/(Lp+d) \qquad \text{Formula 1}$$

As described, the reference symbol v designates a speed of the carrying belt 8 in the paper carrying direction α, and the reference symbol designates the paper interval. Therefore, d/v designates a paper interval time. A reference symbol Lp is a predetermined value. Therefore, the value of G changes depending on the value of the paper interval time d/v. If the value of v is large and the value of d is small, the value of G becomes large. However, the value of the paper interval d and the value of the paper interval time d/v cannot be drastically changed because of a limitation in control by the control unit 206 or the performance of the image forming apparatus 1000.

Incrementing of the paper interval d makes the image forming productivity G lower as described above. Said differently, the image forming productivity G corresponds to the paper interval d. A normal image forming productivity G1 corresponds to a normal paper interval D. The normal paper interval is ordinarily determined for an image forming apparatus in designing the image forming apparatus. If the paper distance d becomes greater than the normal paper distance D, the image forming productivity is lowered.

With the image forming apparatus of Embodiment 1, the direction of putting the paper on the carrying belt 8 is changed so as not to move the idle discharge region 30. Therefore, it is possible to prevent the immediately preceding paper 501 and the immediately subsequent paper 502 from existing on the idle discharge region 30 while maintaining the normal paper interval D without changing the normal image forming productivity.

Figure 6:
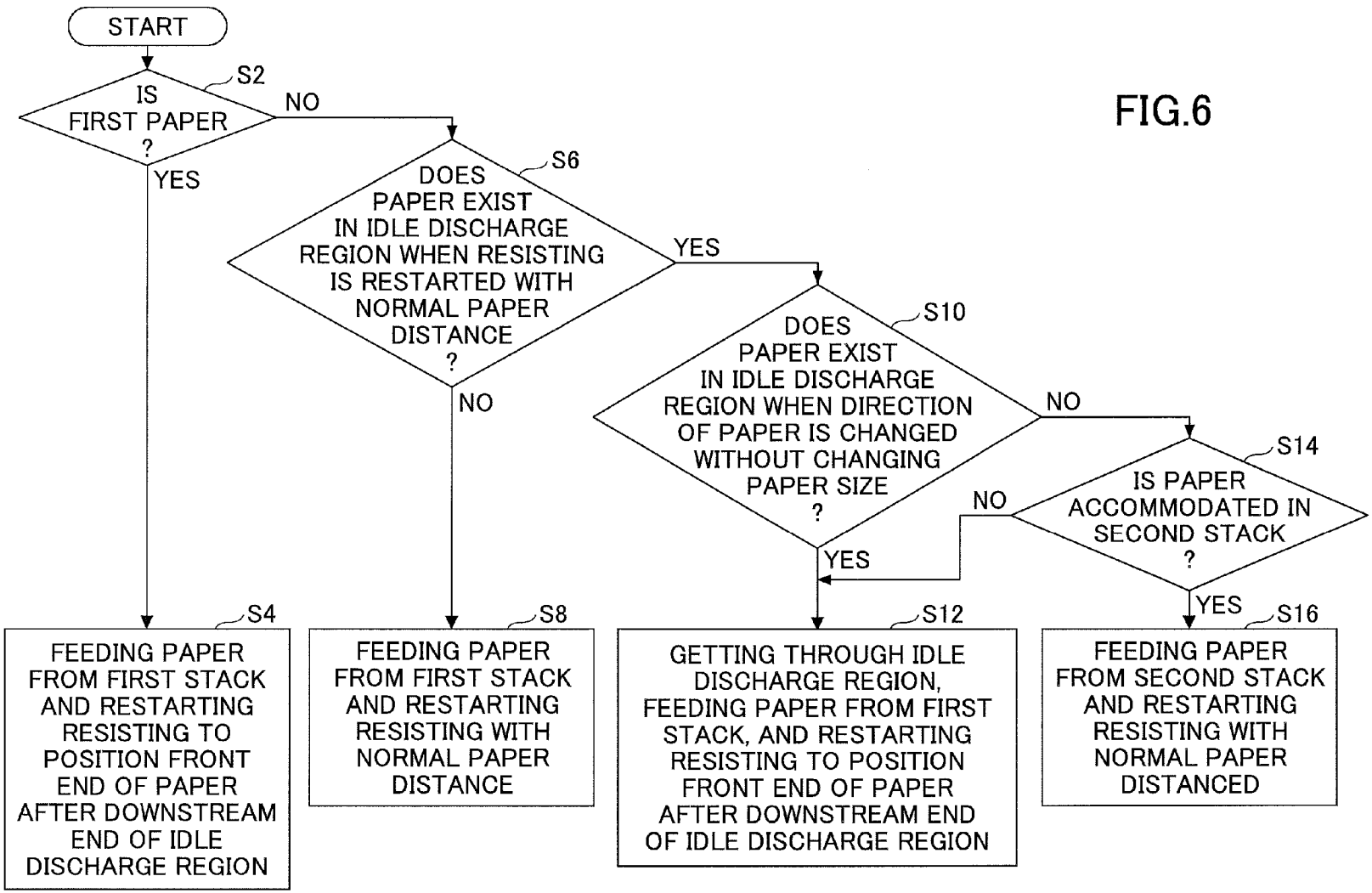
FIG. 6 is a flowchart illustrating a process of changing the paper direction according to Embodiment 1.
Figures 7, 8:
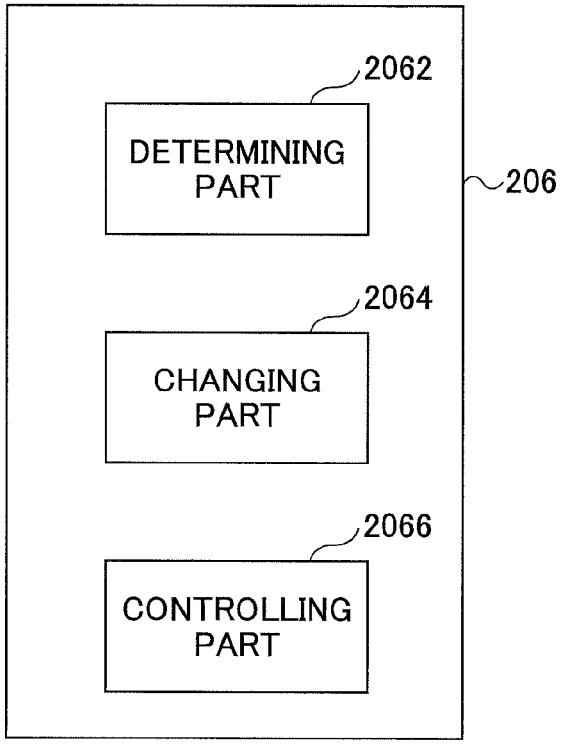
FIG. 7 illustrates an example functional structure of a control unit of Embodiment 1.
FIG. 8 illustrates a first example screen illustrated in a display unit of Embodiment 2.

Next, referring to FIG. 6, a process of changing the paper direction (orientation) is described. FIG. 7 illustrates a functional structure of the control unit 206. As illustrated in FIG. 7, the control unit 206 of Embodiment 1 includes a determining part 2062, a changing part 2064 and a controlling part 2066.

In the example hardware configuration of the image forming apparatus 1000, the first stack 1 accommodates the first papers 3 and the second stack 101 accommodates the second papers 3.

Figure 5:
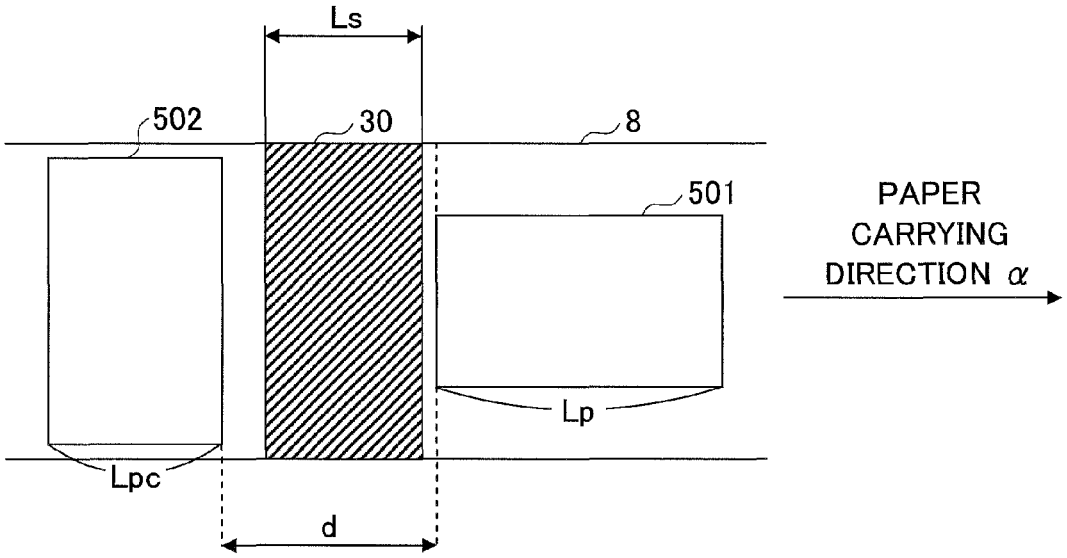
FIG. 5 illustrates changing of a paper direction according to Embodiment 1.

The sizes of the first and second papers 3 and 301 are the same but the directions of the first and second papers 3 and 301 are different. Referring to FIG. 5, the difference of the directions of the first and second papers 3 may be about 90 degrees. However, the difference may be another amount such as 80 degrees. For example, the first paper is put on the carrying belt 8 in the direction of the immediately preceding paper 501 illustrated in FIG. 5, and the second paper is put on the carrying belt 8 in the direction of the immediately subsequent paper 502 illustrated in FIG. 5. The immediately preceding paper 501 is put on the carrying belt 8 so that a longitudinal direction of the immediately preceding paper 501 is substantially parallel to the paper carrying direction α of the papers. The immediately subsequent paper 502 is put on the carrying belt 8 so that a lateral direction of the immediately subsequent paper 502 is substantially in parallel to the paper carrying direction α of the papers.

Referring to FIG. 6, the determining part 2062 determines whether the paper on the carrying belt 8 is the first sheet in step S2.

If the determining part 2062 determines that the paper on the carrying belt 8 is the first sheet in YES of step S2, the process goes to step S4. In step S4, the first paper 3 is fed from the first stack 1. Resisting is started so that the first paper 3 is not positioned on the idle discharge region 30. Alternatively, ordinary resisting may be first stopped. Then, resisting is restarted so that the first paper 3 is not positioned on the idle discharge region 30. It is unnecessary to consider the paper interval d and the image forming productivity G for the first sheet. Therefore, the first sheet of the first paper 3 is prevented from existing on the idle discharge region 30 in resisting the papers.

If the determining part 2062 determines that the paper on the carrying belt 8 is not the first sheet in NO of step S2, said differently the second or later sheet is put on the carrying belt 8, the process goes to step S6.

In step S6, the determining part 2062 determines whether the paper is positioned in the idle discharge region if resisting is restarted using the normal paper interval D after putting the paper on the carrying belt 8.

In step S6, the following formula 2 may be used for the determination.

$$(Lp+d)\cdot(N-1)+Lp>Lb-Ls, \quad \text{Formula 2}$$

where Lp designates the length of the immediately preceding paper 501 in the paper carrying direction α; Lb designates the length of the carrying belt 8 (upper path 8X along carrying belt 8); Ls designates the length of the idle discharge region 30 in the paper carrying direction α; N designates the number of papers put on the carrying belt 8; and d designates the paper interval between the immediately preceding paper and the immediately subsequent paper as described above (see FIG. 5). Provided that the number of the papers which can be simultaneously put on the carrying belt 8 is M, and the number of papers actually put on the carrying belt 8 is m, the number N can be determined as follows:

$$N=m\ (m<M) \text{ or } N=M\ (m\geqq M) \quad \text{Formula 3}$$

When it is determined that Formula 2 is established, the immediately subsequent paper 502 is assumed to exist on the idle discharge region 30. Therefore, if the determining part 2062 determines Formula 2 is established, it is assumed that the immediately subsequent paper 502 is positioned on the idle discharge region 30.

If the determining part 2062 determines that the immediately subsequent paper 502 does not exist on the idle discharge region 30, the control unit 206 causes the immediately subsequent paper 501 to be fed from the second stack 301. The determination of whether the paper exists on the idle discharge region 30 is not based on Formula 2 but also based on other criteria.

Meanwhile, if the determining part 2062 determines that Formula 2 is not established and the immediately subsequent paper 502 exists on the idle discharge region 30, the process goes to step S10. The determining part 2062 determines whether the paper exists on the idle discharge region 30 if the direction of a sheet of the papers is changed in step S10.

In step S10, the following formula 4 may be used for the determination.

$$(Lp+d)\cdot(N-1)+Lpc>Lb-Ls, \quad \text{Formula 4}$$

where Lpc designates the length in the paper carrying direction α of the paper whose direction is changed (see FIG. 5). The first paper 3 accommodated in the first stack 1 is longer than the second paper 301 accommodated in the second stack 101 in the paper carrying direction α. If formula 4 is established, the paper whose direction is changed may exist on the idle discharge region 30. If the determining part 2062 determines that Formula 4 is established, the process goes to step S12.

In step S12, the carrying belt 8 is driven so that the idle discharge region 30 passes beneath the recording head 18. The control unit 206 may make the recording head discharge ink when the idle discharge region 30 passes beneath the recording head 18. Referring to FIG. 4, after the idle discharge region 30 passes beneath the recording head, resisting is restarted so that the front end 20 of the immediately subsequent paper 502 is positioned after an end β of the downstream idle discharge region 30 in step S12.

If the determining part 2062 determines that Formula 4 is not established, the process goes to step S14. In step S14, the determining part determines whether the paper is accommodated in the second stack 101. If the determining part 2062 determines that the paper is not accommodated in the second stack 101, the process goes to step S12.

If the determining part 2062 determines that the paper is accommodated in the second stack 101 in YES of step S14, the process goes to step S16. In step S16, the changing part 2064 of the control unit 206 makes the second stack 101 feed the second paper 301 to put the second paper on the carrying belt 8. On this occasion, the second paper 301 may be supplied to the carrying belt 8 via the pair of paper feeding rollers 505 and the pair of resist rollers 2 or the other resist rollers (not illustrated in FIG. 3). Then, the state illustrated in FIG. 5 is realized. Referring to FIG. 5, the immediately subsequent paper 501 does not exist on the idle discharge region 30 and the normal paper interval D between the immediately preceding paper 501 and the immediately subsequent paper 502 can be maintained.

Said differently, the determining part 2062 determines whether the paper is put on the idle discharge region 30 in step S6. If the determining part 2062 determines that the paper is put on the idle discharge region 30 in YES of step S6, the determining part 2062 changes the paper direction and puts the paper whose direction is changed on the carrying belt 8 to start resisting in step S16.

Although the changing part 2064 changes the paper direction, the changing part 2064 may also change the direction of the image data in response to the paper whose direction is changed. In the case where the paper direction is changed by 90 degrees, the image data are also changed by 90 degrees.

There are many ways to change the image data. For example, the changing part 2064 may change the direction of the image data stored in the main memory unit 312. As such, the directions of the paper and the image data need to be considered.

Figure 15:
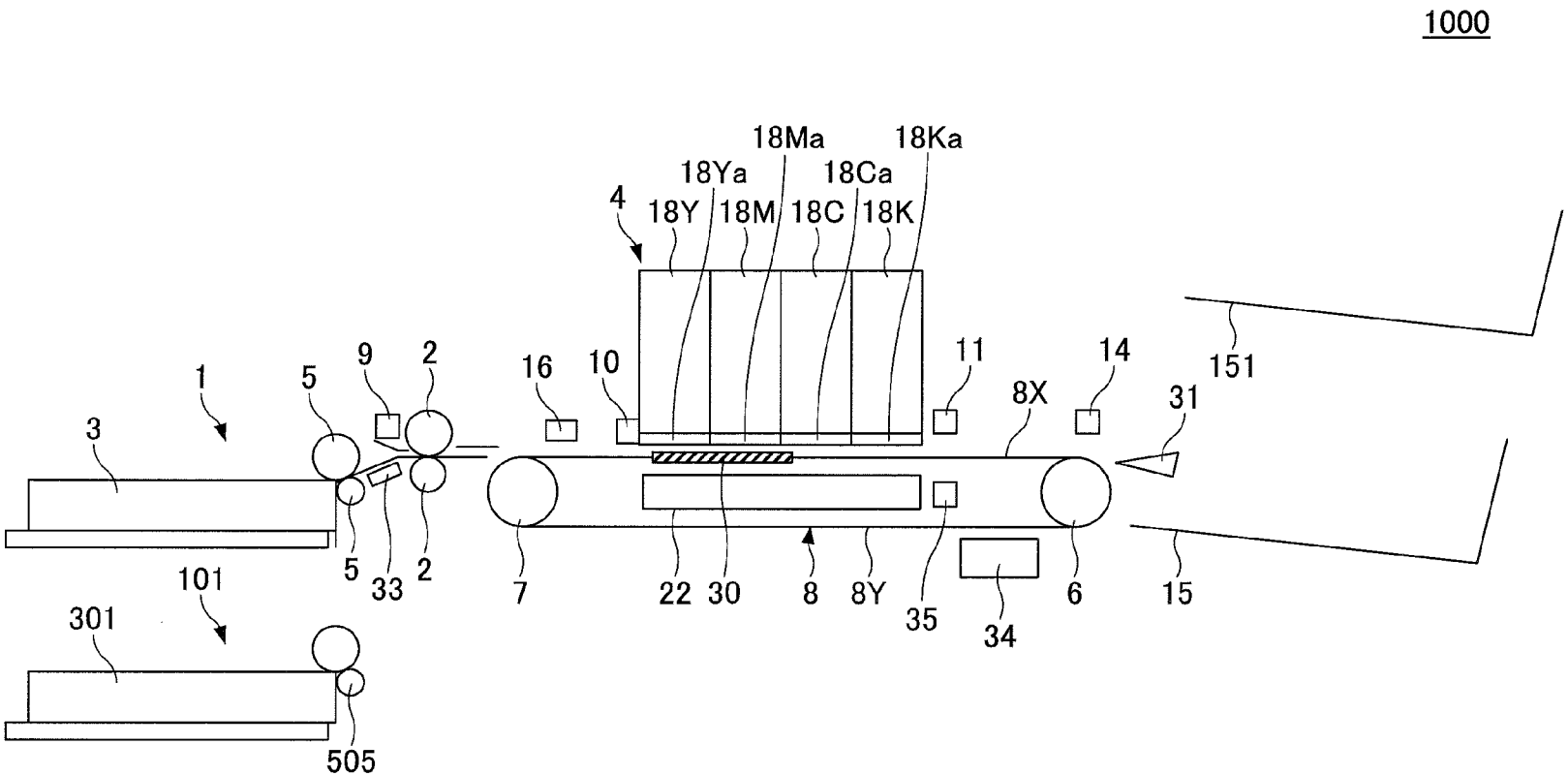
FIG. 15 illustrates an example hardware configuration of an image forming apparatus of Embodiment 9.

Although the way of changing the paper direction using the first and second stacks 1 and 101 has been described, the first stack 1 and a paper direction switching claw 33 may be used without using the second stack 101 as illustrated in FIG. 3 and FIG. 15. The paper direction switching claw 33 may be provided in a paper carrying path between the first stack 1 and the carrying belt 8. When the paper direction may be changed by the paper direction switching claw 33 by about 90 degrees with control by the control unit 206.

With Embodiment 1, even if the paper is determined to be positioned on the idle discharge region 30, it is possible to shorten the length of the paper carrying direction α of the carrying belt 8 by changing the paper direction if the paper is determined to exist on the idle discharge region 30. Therefore, it is possible to put the paper on the idle discharge region while maintaining the interval between the adjacent papers to be a normal paper interval. Further, if the paper interval becomes long, a time duration of not discharging the ink becomes long and the ink is prone to be dried. Therefore, if the paper interval can be maintained to be the normal paper interval, the image forming productivity can be assured and the ink is not easily dried in the recording head 18.

Embodiment 2

With Embodiment 1, in the above step S14 of FIG. 6, the determining part 2062 determines whether the second paper 301 is accommodated in the second stack 101. However, the second paper 301 may not be accommodated in the second stack 101.

The reason why the second paper 301 may not be accommodated in the second stack 101 may be: (i) even if the paper exists in the second stack 101, the direction of the paper supplied from the second stack is the same as that of the paper in the first stack 1; or (ii) even if the paper is accommodated in the second stack 101, the paper type or the paper thickness of the paper is different from that of the paper in the first stack 1; or (iii) the paper in the second stack has run out. Said differently, when the second paper 301 having the same size as that of the first paper 3 and directed to a direction different from that of the first paper 3 is not accommodated in the second stack 101, Embodiment 2 is applicable.

Information indicative of not accommodating the second paper 301 in the second stack 101 is referred to as non-accommodating information. The non-accommodating information is displayed on the first display unit 3182 (see FIG. 2). When the determining part 2062 determines NO in step S14, the non-accommodating information is displayed on the first display unit 3182 and goes to step S12.

A display example of the non-accommodating information is illustrated in FIG. 8. Referring to FIG. 8, the second tray corresponds to the second stack.

There are various ways of displaying the non-accommodating information. For example, a screen illustrated in FIG. 8 may be displayed on the first display unit 3182. Instead of displaying on the first display unit 3182 (see FIG. 2), a speaker may be used for an audio output to report the content illustrated in FIG. 8. It is possible to make the user recognize the content illustrated in FIG. 8 by printing the content illustrated in FIG. 8.

In the image forming apparatus of Embodiment 2, if the second paper 301 is not accommodated in the second stack 101, the non-accommodating information indicative of the non-accommodating state on the first display unit 3182. Therefore, the user can recognize an issue that the second paper is not accommodated in the second stack 101, and the paper may be supplied to the second stack 101.

Embodiment 3

With Embodiment 3, the first operations unit 3172 (see FIG. 2) is provided in the image forming apparatus of Embodiment 2. If the second paper 301 is not accommodated in the second stack 101, it is possible for the user to select an operation of "charging (adding) papers to the second stack" or an operation of "printing with a stable paper direction being fixed". The selection is carried out when the user operates the first operations unit 3172. In the selection of "printing with a stable paper direction being fixed", only the first paper 3 inside the first stack 1 is used to continue printing without charging (adding) the second paper 301 to the second stack 101. The selection of "charging papers to the second stack" includes not only charging the second paper 301 to the second stack 101 but also adding paper having the same paper type and same thickness as those of the first paper 1 to the second stack 101 when the paper types or paper thicknesses of the first and second papers 3 and 301 are different.

Figure 9:
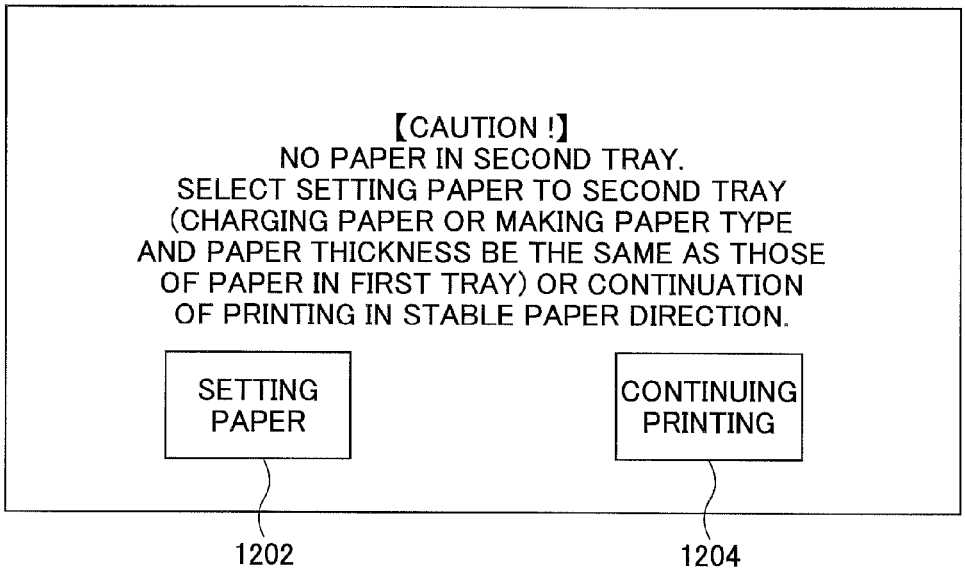
FIG. 9 illustrates a first example screen illustrated in an operations unit of Embodiment 3.

Referring to FIG. 9, if the user wishes "charging papers to the second stack", a button 1202 of setting paper is pushed down or touched. If the user wishes "printing with a stable paper direction being fixed", a button 1204 of continuing printing is pushed down or touched.

Here, a printing mode in which the paper direction is changed is referred to as "variable paper direction mode", and a printing mode in which the paper direction is stable is referred to as "stable paper direction mode".

If a user pushes down or touches the button 1204 of continuing printing, a signal for continuing printing is sent to the control unit 206 to set the image forming apparatus to the stable paper direction mode. If the user pushes down or touches the button 1202 of setting paper and the paper is actually charged to the second tray as the second stack 101, a signal indicative of the variable paper direction mode is sent to the control unit 206 to thereby set the image forming apparatus to the variable paper direction mode.

With the image forming apparatus of Embodiment 3, even if the second paper 301 is not accommodated in the second stack 101, the user can more easily select when the user is prompted to select "charging papers to the second stack" or "printing with a stable paper direction being fixed".

Embodiment 4

Figure 10:
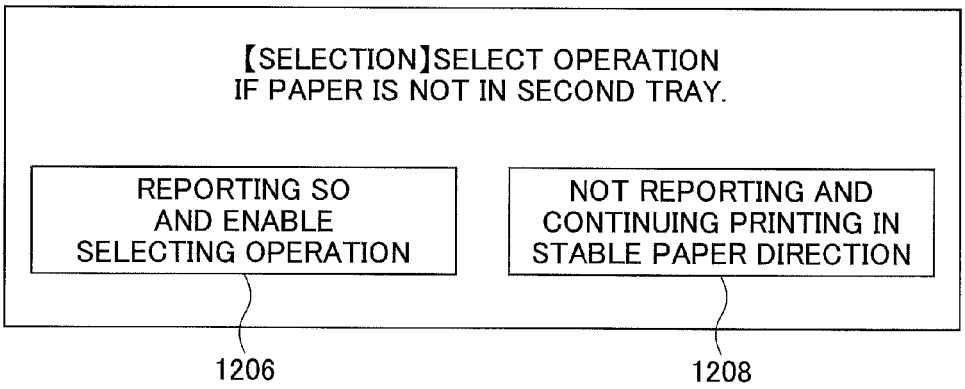
FIG. 10 illustrates a second example screen illustrated in an operations unit of Embodiment 4.

With Embodiment 4, the second operations unit 3174 (see FIG. 2) is provided in the image forming apparatus of Embodiment 3. The second operations unit 3174 may display a screen illustrated in FIG. 10. Via the display illustrated in FIG. 10, operations can be selected if the paper is not accommodated in the second stack 101. Referring to FIG. 10, the second tray corresponds to the second stack 101. Referring to FIG. 10, the following operations are selectable: (i) the non-accommodating information described in Embodiment 2 is displayed on the first displaying unit 3182 to enable selection of the operations via a button 1206; or (ii) printing is continued in the stable paper direction mode without displaying the non-accommodating information on the first display unit 3182 via a button 1208. If the button 1206 is pushed down or touched, the operations of "charging papers to the second stack" or of "printing with a stable paper direction being fixed" illustrated in FIG. 9 can be selected by the user.

If the user pushes down or touches the button 1206, a signal corresponding to the operation (i) is sent to the control unit 206. Meanwhile, if the user pushes down or touches the button 1208, a signal corresponding to the operation (ii) is sent to the control unit 206.

With the image forming apparatus of Embodiment 4, if the second paper 301 is not accommodated in the second tray (the second stack 101), the user can select the button 1206 based on the reported non-accommodating information or the button 1208 without receiving the non-accommodating information. Therefore, the user needs not receive the non-accommodating information when it is not required by the user. Thus, a cost for displaying the non-accommodating information can be reduced.

The screen of FIG. 10 may be displayed at an initial setup or every print setup.

Embodiment 5

As described, with Embodiment 1, the normal paper interval is maintained by changing the paper direction on the carrying belt 8 to thereby prevent the paper from existing on the idle discharge region 30. However, depending on a situation, the stable paper direction mode may be selected without changing the paper direction. The stable paper direction mode may be selected by pushing down or touching the button 1208 of FIG. 10. As examples, the stable paper direction mode is selected in the following cases:

(Case 1)

Processes such as stapling, punching, bending and ring-binding (hereinafter, referred to as post-processing) are carried out after forming the image (printing on the paper) and the paper cannot have been rotated when the paper is sent to a post-processing device for post-processing. If the paper direction is changed, a paper bundle having longitudinally and laterally arranged papers is formed to prevent the post-processing. Accordingly, the paper direction is stabilized in (Case 1).

(Case 2)

With Embodiment 1, the direction of the image data is changed by the changing part 2064 along with the change of the paper direction. However, if the image forming apparatus 1000 does not have a function of changing the image data and the changing part 2064 cannot change the direction of the image data, all images are not appropriately printed on the papers. For example, the image may be trimmed. Therefore, if the function of changing the image data does not exist in the image forming apparatus 1000, the paper direction is set to be stable.

(Case 3)

The paper direction is required to be stable in a mode of sorting the ejected papers using only one bin by piling a longitudinally arranged paper bundle and a laterally arranged paper bundle such as an electronic sort.

The stable paper mode is not limited to these cases 1-3 and may be selected when necessary.

Figures 11, 12:
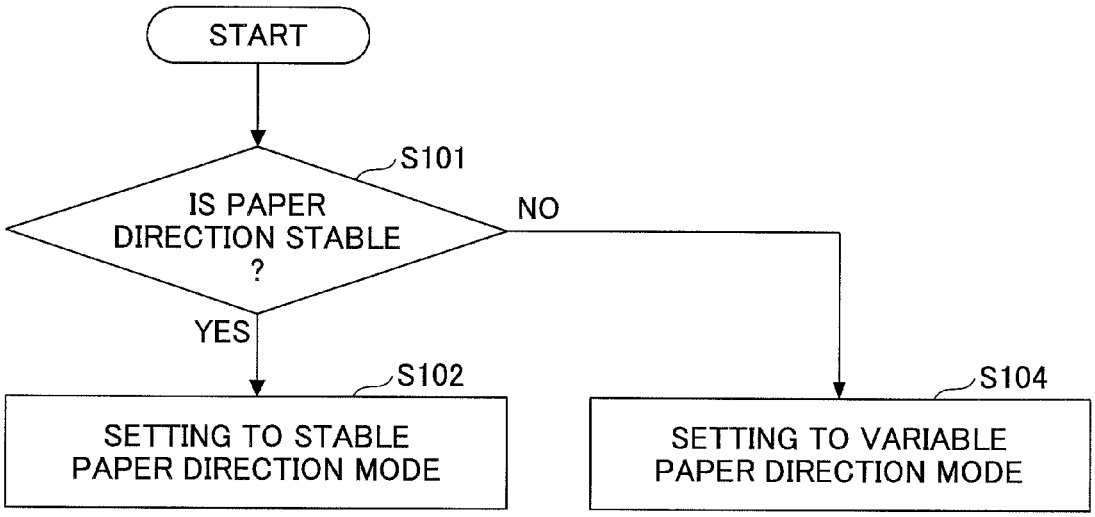
FIG. 11 illustrates a flow of changing to a variable paper direction mode or a stable paper direction mode of Embodiment 5.
FIG. 12 illustrates a second example screen illustrated in a display unit of Embodiment 6.

Referring to FIG. 11, "variable paper direction mode" or "stable paper direction mode" may be selected. In step S101, the controlling part 2066 determines whether the paper direction is stable or variable. The controlling part 2066 may determine whether the paper direction is stable or variable by itself. If the controlling part 2066 determines to select the stable paper direction mode as described in the cases 1-3, it is determined that the paper direction is stable in YES of step S101. Then, the process goes to step S102. In step S102, the control unit 206 sets the image forming apparatus 1000 to be in the stable paper direction mode. Under the stable paper direction mode, the controlling part 2066 does not make the changing part 2064 change the paper direction.

On the other hand, if the controlling part 2066 determines not to select the stable paper direction mode, it is determined that the paper direction is variable in NO of step S101. Then, the process goes to step S104. In step S104, the control unit 206 sets the image forming apparatus 1000 to be in the variable paper direction mode.

Embodiment 6

If the paper direction is set to be stable as in Embodiment 5, the paper interval d illustrated in FIG. 1B may be increased to a paper interval d' as illustrated in FIG. 1C to thereby lower the image forming productivity. However, if printing is continued while the user cannot recognize the lowered image forming productivity, the user may be suspicious of the performance of the image forming apparatus 1000. With Embodiment 6, when the image forming apparatus 1000 is set to be in the stable paper direction mode, the user is reported so via the second display unit 3184 to recognize a probability of the lowered image forming productivity.

There are various ways of displaying the probability of the lowered image forming productivity. For example, a screen illustrated in FIG. 12 may be displayed on the second display unit 3184. Instead of displaying on the second display unit 3184 (see FIG. 2), a speaker may be used for an audio output to report the content illustrated in FIG. 12. It is possible to make the user recognize the content illustrated in FIG. 12 by printing the content illustrated in FIG. 12.

With Embodiment 6, the user can recognize the lowered image forming productivity by indication of the probability of the lowered image forming productivity if the image forming apparatus is set to be in the stable paper direction mode.

Figure 16:
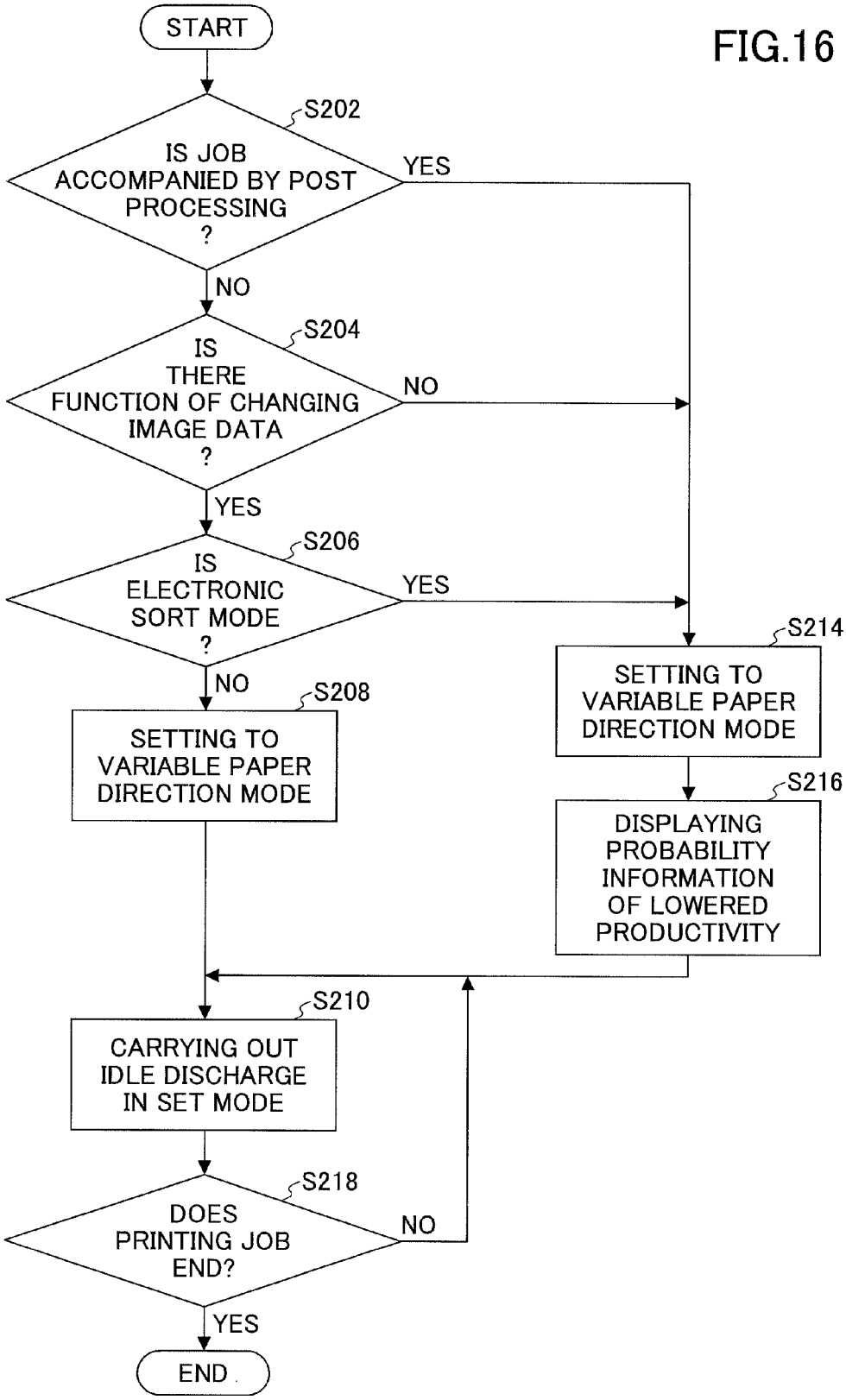
FIG. 16 is an example flowchart illustrating a process of changing a paper direction according to Embodiments 5 and 6.

Referring to FIG. 16, a flow chart of the processes in Embodiments 5 and 6 is described. In step S202, the determining part 2062 determines whether a current printing job is accompanied by post-processing (e.g., Case 1). If the determining part 2062 determines the current printing job is not accompanied by the post-processing in NO of step S202, the process goes to step S204. If the determining part 2062 determines the current printing job is accompanied by the post-processing in YES of step S202, the process goes to step S214.

In step S204, the determining part 2062 determines whether the image forming apparatus 1000 has a function of changing the image data (e.g., Case 2). If the determining part 2062 determines the current printing job is accompanied by the function of changing the image data in YES of step S204, the process goes to step S206. If the determining part 2062 determines that the image forming apparatus 1000 does not have the function of changing the image data in NO of step S204, the process goes to step S214. The information of whether the function of changing image data exists in the image forming apparatus 1000 may be stored in the main memory unit 312 or the auxiliary memory unit 313 in advance. The determining part 2062 may determine whether the function of changing image data exists in the image forming apparatus 1000 by referring to the stored information.

In step S206, the determining part 2062 determines whether a currently set mode is an electronic sort mode. If the determining part 2062 determines that the currently set mode is not the electronic sort mode in NO of step S206, the process goes to step S208. If the determining part 2062 determines that the currently set mode is the electronic sort mode in YES of step S206, the process goes to step S214.

In step S208, the control unit 206 sets the image forming apparatus 1000 to be in the variable paper direction mode. In step S214, the control unit 206 sets the image forming apparatus 1000 to be in the stable paper direction mode. After processing step S214, the control unit 206 displays the provability information of lowered productivity (see FIG. 12) on the second display unit 3184 in step S216. After processing steps S208 and S216, the control unit 206 makes the image forming unit 4 to idle-discharge ink in step S210. The determining part 2062 determines whether a current printing job ends in step S218. If the determining part 2062 determines that the current printing job ends in YES of step S218, the process ends. Meanwhile, if the determining part 2062 determines that the current printing job does not end in NO of step S218, the process goes back to step S210 to continue an operation of idle discharge.

Steps S202, S204 and S206 may be processed in an order other than this sequence or in parallel.

With Embodiments 5 and 6, the variable paper direction mode or the stable paper direction mode is automatically selected.

Embodiment 7

In the variable paper direction mode in which the longitudinally and laterally arranged printed papers are mixed in Embodiment 5, a user may arrange printed paper directions when necessary. With Embodiment 7, the user can select one of the stable paper direction mode and the variable paper direction mode.

Figures 13, 14:
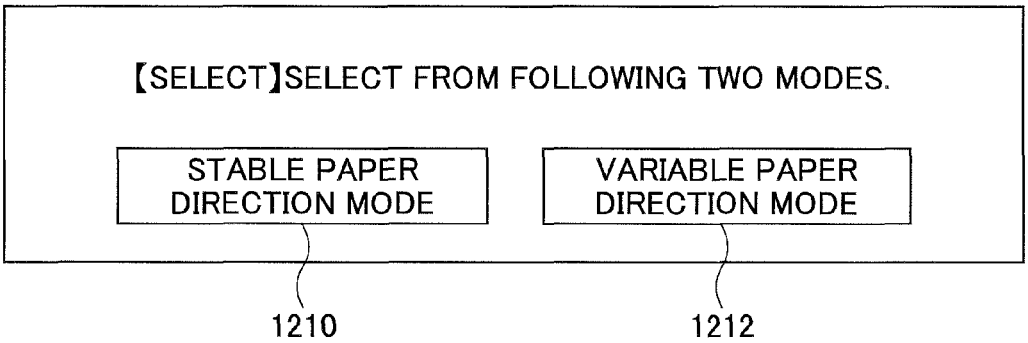
FIG. 13 illustrates a third example screen illustrated in an operations unit of Embodiment 7.
FIG. 14 illustrates an example table of Embodiment 8.

A screen displayed on the third operations unit 3176 enabling the user to select the stable paper direction mode or the variable paper direction mode is illustrated in FIG. 13.

If the user wishes to select the stable paper direction mode, the user pushes down or touches a stable paper direction mode button 1210. Then, a signal corresponding to the stable paper direction mode is sent to the control unit 206 to thereby set the stable paper direction mode to the image forming apparatus 1000. If the user wishes to select the variable paper direction mode, the user pushes down or touches a stable paper direction mode button 1212. Then, a signal corresponding to the variable paper direction mode is sent to the control unit 206 to thereby set the variable paper direction mode in the image forming apparatus 1000.

Therefore, if the user wishes to improve image forming productivity, the user selects the variable paper direction mode with the above selection. If the user does not wish to improve image forming productivity, the user selects the stable paper direction mode with the above selection.

Embodiment 8

Referring to FIG. 4, Embodiment 8 is described. Referring to FIG. 4, a downstream side of the idle discharge region 30 in the paper carrying direction α is designated by γ. A distance between the back end 19 of the immediately preceding paper 501 and the downstream side γ is designated by Y.

The longer the distance Y between the back end 19 of the immediately preceding paper 501 and the downstream side γ is, the longer is a time interval T between a time T1 when ink is discharged for forming an image on the immediately preceding paper 501 and a time T2 when ink is idle-discharged. Therefore, the ink is not discharged during the time interval T. The nozzle face of the recording head is further dried as the distance Y between the back end 19 of the immediately preceding paper 501 and the downstream side γ increases.

In the image forming apparatus of Embodiment 8, the quantity of ink to be idle-discharged is determined based on the distance Y between the back end 19 of the immediately preceding paper 501 and the downstream side γ (hereinafter referred to as a distance between the recording medium and the idle discharge region). A relationship between the quantity of ink to be idle-discharged and the distance Y between the back end 19 of the immediately preceding paper 501 and the downstream side γ is stored as a table in the main memory unit 312. Referring to FIG. 14, if the value of the distance between the recording medium and the idle discharge region is Y1, the quantity of ink to be idle-discharged is Z1; and if the value of the distance between the recording medium and the idle discharge region is Yn, the quantity of ink to be idle-discharged is Zn (n is a natural number of 2 or more).

Further, Y1<Y2 . . . <Yn, and Z1<Z2 . . . <Zn.

The distance Y between recording medium and idle discharge region is detected by the recording position detecting part 10. The recording position detecting part 10 detects the back end 19 of the immediately preceding paper 501 and the downstream side γ of the idle discharge region 30. Among the distances between recording medium and idle discharge region Y1 to Yn, the distance closest to the distance detected by the recording position detecting part 10 is determined. The quantity Z1 to Zn of ink to be idle-discharged corresponding to the determined distance Y1 to Yn is acquired in reference to the table in FIG. 14. The control unit 206 makes the recording head idle-discharge ink by the acquired quantity of ink to be idle-discharged.

A way of determining the quantity of ink to be idle-discharged without using the table illustrated in FIG. 14 is described. As described, the quantity Z of ink to be idle-discharged is increased as the distance Y between recording medium and idle discharge region is increased. The quantity Z of ink to be idle-discharged and the distance Y between recording medium and idle discharge region may be in proportional relation. Formula 5 may be used.

$$Z=aY, \qquad \text{Formula 5}$$

where a designates a proportional constant, which is empirically obtained. Formula 5 is previously stored in the main memory unit 312. If the distance Y between recording medium and idle discharge region is determined, the control unit 206 acquires the quantity Z of ink to be idle-discharged using Formula 5.

Another way of determining the idle discharge without using the quantity Z of ink to be idle-discharged is described next. The determining part 2062 determines whether the distance Y between recording medium and idle discharge region is larger than a predetermined threshold value y. If the distance Y between recording medium and idle discharge region is smaller than the predetermined threshold value y, the time interval T is short enough to prevent drying of the nozzle face by an appropriate idle discharge of the ink. The quantity of ink to be idle-discharged is the predetermined quantity Z. If the determining part 2062 determines that the distance Y between recording medium and idle discharge region is shorter than the predetermined threshold value y, the control unit 206 makes the recording head idle-discharge ink by the predetermined quantity Z.

If the distance Y between recording medium and idle discharge region is the predetermined threshold value y or more, the time interval T is long. Then, the nozzle face is prone to be dried by an insufficient idle-discharge of the ink. If the determining part 2062 determines that the distance Y between recording medium and idle discharge region is the predetermined threshold value y or more, the control unit 206 makes the recording head idle-discharge the ink whose quantity is more than the predetermined quantity Z.

As described, the quantity of the ink to be idle-discharged is increased as the distance Y between recording medium and idle discharge region becomes long. Thus, if the distance Y between recording medium and idle discharge region is long enough to cause the nozzle face to be dried, the quantity of the ink to be idle-discharged is increased to thereby prevent the nozzle face from being dried.

Embodiment 9

Referring to FIG. 15, a hardware configuration of an image forming apparatus of Embodiment 9 is described. The image forming apparatus illustrated in FIG. 15 differs from the image forming apparatus illustrated in FIG. 3 at a point in which a second catch tray 151 is provided in addition to the first catch tray 15.

If an image is printed in the variable paper direction mode described in Embodiment 3, the longitudinally and laterally arranged printed papers are mixed and ejected. Therefore, a user arranges the paper directions by hand when necessary. Referring to FIG. 15, the first catch tray 15 receives the laterally arranged printed papers, and the second catch tray 151 receives the longitudinally arranged printed papers. Said differently, if the first paper 3 stacked in the first stack 1 is printed, the printed paper is received in the first catch tray 15. If the second paper 301 stacked in the second stack 101 is printed, the printed paper is received in the second catch tray 151. Referring to FIG. 15, an ejecting destination switching claw 31 is provided to switch directions of sending the printed papers to the first catch tray 15 or the second catch tray 151. The control unit 206 controls the ejecting destination switching claw 31 to switch directions of sending the printed papers to the first catch tray 15 or the second catch tray 151.

With the image forming apparatus of Embodiment 7, the user needs to select the improvement of the image forming productivity or the arrangement of the paper directions by hand. However, in the image forming apparatus of Embodiment 9, the image forming productivity is enhanced without the arrangement of the paper directions by hand.

In Embodiments 1 to 9, the ink may be directly idle-discharged on a carrying belt having no idle discharge hole if a portion of the carrying belt corresponding to the idle discharge region 30 can be cleaned. In order to clean the portion, a cleaning mechanism 35 (see FIG. 3 and FIG. 15) is provided and the material of the portion corresponding to the idle discharge region 30 of the carrying belt is cleanable. Further, in Embodiments 1-9, an electrostatic attraction mechanism is provided to attract the paper toward the carrying belt. However, suction holes may be provided in the carrying belt to suction air for holding the paper toward the carrying belt. In this case, an air suction mechanism such as a fan 35 (see FIG. 3 and FIG. 15) may be provided.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiment of the present invention has been described in detail, it should be understood that various changes, substitutions, and alterations could be made thereto without departing from the spirit and scope of the invention.

This patent application is based on Japanese Priority Patent Application No. 2010-148122 filed on Jun. 29, 2010 and Japanese Priority Patent Application No. 2011-128266 filed on Jun. 8, 2011, the entire contents of which are hereby incorporated herein by reference.

What is claimed is:

1. An image forming apparatus, comprising:

an image forming unit configured to discharge ink for forming an image on a recording medium or for idle-discharging the ink on other than the recording medium;

a carrying unit configured to carry the recording medium, the carrying unit including an idle discharge region for receiving the ink which is idle-discharged on the carrying unit carrying the recording medium;

a determining part configured to determine whether the recording medium is positioned at the idle discharge region; and a changing part configured to change, if the determining part determines that the recording medium is positioned at the idle discharge region, a direction of the recording medium so that the recording medium is not positioned at the idle discharge region.

2. The image forming apparatus according to claim 1, further comprising:

a first stack configured to accommodate a first recording medium; and a second stack configured to accommodate a second recording medium whose size is the same as a size of the first recording medium and whose direction is different from a direction of the first recording medium, wherein the recording medium includes the first recording medium and the second recording medium, and the changing part changes the direction of the recording medium by feeding the second recording medium instead of the first recording medium.

3. The image forming apparatus according to claim 1, further comprising:

a first display unit configured to display non-accommodating information indicating, if the second recording medium is not accommodated in the second stack, that the second recording medium is not accommodated in the second stack.

4. The image forming apparatus according to claim 3, further comprising:

a first operations unit configured to make, if the second recording medium is not accommodated in the second stack, a user select whether a process of forming the image is continued or the second recording medium is charged to the second stack.

5. The image forming apparatus according to claim 3, further comprising:

a second operations unit configured to make, if the second recording medium is not accommodated in the second stack, a user select whether the non-accommodating information is displayed on the first displaying unit or the image is formed by the image forming unit on the first recording medium without changing the direction of the recording medium.

6. The image forming apparatus according to claim 1, wherein the changing part changes the direction of the recording medium by 90 degrees.

7. The image forming apparatus according to claim 1, further comprising:

a controlling part configured to make the changing part change the direction of the recording medium or not to make the changing part change the direction of the recording medium.

8. The image forming apparatus according to claim 7, further comprising:

a second display unit configured to display, if the controlling part does not make the changing part change the direction of the recording medium, provability information of lowered image forming productivity.

9. The image forming apparatus according to claim 7, wherein the controlling part makes the changing part change the direction of the recording medium or does not make the changing part change the direction of the recording medium based on an operation from a user.

10. The image forming apparatus according to claim 1, wherein a quantity of the ink to be idle-discharged is determined based on a distance between a downstream side of the idle discharge region and an upstream side of the recording medium on which the image is formed and which recording medium is positioned adjacent to and downstream of the idle discharge region.

11. The image forming apparatus according to claim 1, further comprising:

a plurality of catch trays configured to receive the recording medium corresponding to a plurality of changed directions of the recording medium.

12. An image forming method, comprising:

discharging ink for forming an image on a recording medium or idle-discharging the ink on other than the recording medium:

carrying the recording medium on a carrying unit which includes an idle discharge region for receiving the ink which is idle-discharged on the carrying unit carrying the recording medium;

determining whether the recording medium is positioned at the idle discharge region; and changing, if the determining determines that the recording medium is positioned at the idle discharge region, a direction of the recording medium so that the recording medium is not positioned at the idle discharge region.

13. The image forming method according to claim 12, wherein the recording medium includes a first recording medium and a second recording medium whose size is the same as a size of the first recording medium and whose direction is different from a direction of the first recording medium, and the changing changes the direction of the recording medium by feeding the second recording medium instead of the first recording medium.

14. The image forming method according to claim 12, further comprising:

displaying non-accommodating information indicating, if the second recording medium does not exist, that the second recording medium does not exist.

15. The image forming method according to claim 14, further comprising:

making, if the second recording medium does not exist, a user select whether a process of forming the image is continued or the second recording medium is charged.

16. The image forming method according to claim 14, further comprising:

making, if the second recording medium does not exist, a user select whether the non-accommodating information is displayed or the image is formed on the first recording medium without changing the direction of the recording medium.

17. The image forming method according to claim 12, wherein the changing changes the direction of the recording medium by 90 degrees.

18. The image forming method according to claim 12, further comprising:

controlling to make the changing change the direction of the recording medium or not to make the changing change the direction of the recording medium.

19. The image forming method according to claim 18, further comprising:

displaying, if the controlling does not make the changing change the direction of the recording medium, provability information of lowered image forming productivity.

20. The image forming method according to claim 12, further comprising:

determining a quantity of the ink to be idle-discharged based on a distance between a downstream side of the idle discharge region of the carrying unit in a carrying direction and an upstream side of the recording medium on which the image is formed and which recording medium is positioned adjacent to and on downstream side of the idle discharge region of the carrying unit.

* * * * *